United States Patent [19]

Huisl

[11] 4,389,859

[45] Jun. 28, 1983

[54] KNITTING MACHINE

[75] Inventor: Herbert F. Huisl, Tableview, South Africa

[73] Assignee: Colosio Cesare, Botticino Sera, Italy

[21] Appl. No.: 174,909

[22] Filed: Aug. 4, 1980

[30] Foreign Application Priority Data

Aug. 6, 1979 [ZA] South Africa ..... 79/4062
Sep. 7, 1979 [ZA] South Africa ..... 79/4727

[51] Int. Cl.[3] ..... D04B 9/28; D04B 15/60
[52] U.S. Cl. ..... 66/224; 66/140 R
[58] Field of Search ..... 66/43, 133, 134, 138, 66/139, 140 R, 140 S, 224

[56] References Cited

U.S. PATENT DOCUMENTS 1,605,727 11/1926 Hilscher ..... 66/138
2,005,632 6/1935 Page ..... 66/138
2,625,808 1/1953 Green et al. ..... 66/138
2,920,467 1/1960 Dantzler et al. ..... 66/138

FOREIGN PATENT DOCUMENTS 504723 8/1930 Fed. Rep. of Germany ..... 66/133
779894 7/1957 United Kingdom ..... 66/138
780248 7/1957 United Kingdom ..... 66/140 R

*Primary Examiner*—Wm. Carter Reynolds
*Attorney, Agent, or Firm*—Larson and Taylor

[57] ABSTRACT

A knitting machine for knitting tubular knitted wear such as socks, which includes a needle knitting cylinder, yarn cutters, a number of pattern drums, a number of needle selector bars adapted to be operated by the pattern drums and in turn being adapted to operate needles in the knitting cylinder, a number of yarn feeder control drums controlled from a timing chain, and yarn feeders for each yarn feeder control drum, the yarn feeders being adapted to supply yarn to the needle knitting cylinder. The machine further includes an additional yarn feeder control arrangement. This arrangement comprises a control member for controlling each yarn feeder separately from its yarn feeder control drum, movement device adapted to be moved by the associated pattern drum, and coupling member adapted to be operated by the movement device and being adapted to transmit such movement to the control member for causing a particular control to be effected on its associated yarn feeder.

5 Claims, 11 Drawing Figures

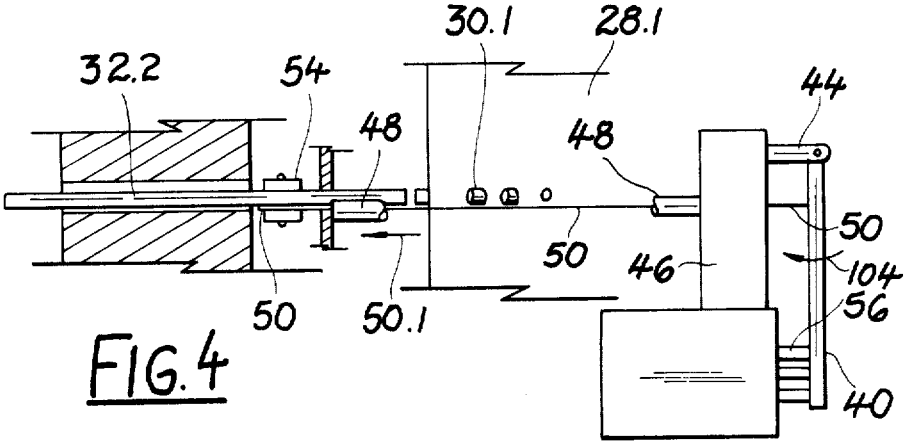
FIG. 4
FIG. 10
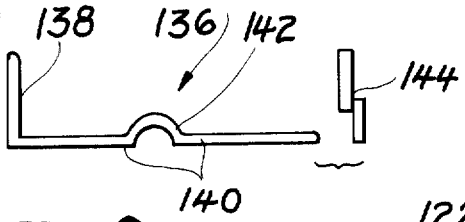
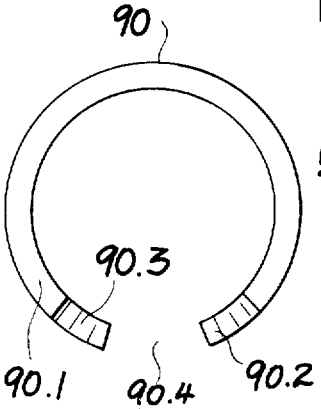
FIG. 8
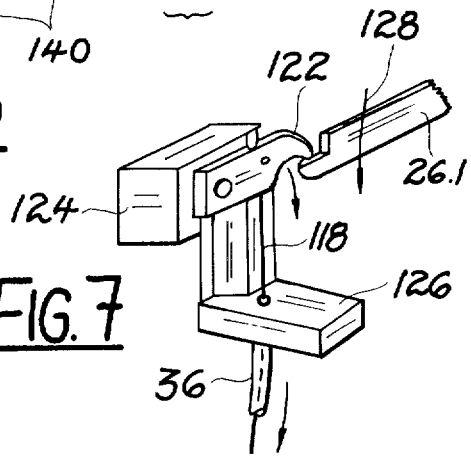
FIG. 7
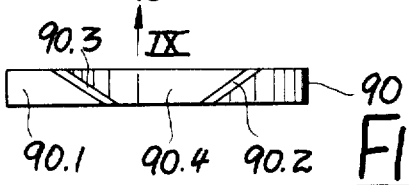
FIG. 9

42
44
46
104
50
52
48
70
38
62
40
64
56
60
58
68
90
90.3
90.2
87
88
86
92
82.1
94
84.2
82
84
38
120
108
84.1
102
106
72
98
80
64
78
96
100
46
62
112
44
80.1
28.1
110
40
76
132
44
130
66
42
68
74
116
56
70
114
114.1
118
36

KNITTING MACHINE

BACKGROUND OF INVENTION

The present invention relates to knitting machines.

More particularly the invention relates to knitting machines for knitting tubular knitted wear such as socks.

In an existing knitting machine four yarn feed groups are provided around a knitting needle cylinder. Each feed group has a number (e.g. 3) yarn feeders and these are controlled by means of a timing chain which operates a feeder control drum, which in turn controls the yarn feeders to put them into or out of operation.

The existing machine further has a pattern drum with holes for removably receiving pins. By means of building up a pattern with pins on this drum, needle selector bars are operable which operate the knitting needles in the knitting cylinder.

For reasons set out in the description of the drawings, the pattern formation is restricted in the present machine.

It is an object of the invention to provide an additional control arrangement for the yarn feeders in order to achieve a greater variation in the patterns which can be produced.

SUMMARY OF INVENTION

According to one embodiment of the invention, a knitting machine for knitting tubular knitted wear such as socks, includes a needle knitting cylinder, yarn cutters, a number of pattern drums, a number of needle selector bars adapted to be operated by the pattern drums and in turn being adapted to operate needles in the knitting cylinder, a number of yarn feeder control drums controlled from a timing chain, and yarn feeders for each yarn feeder control drum, the yarn feeders being adapted to supply yarn to the needle knitting cylinder, the machine further including an additional yarn feeder control arrangement which includes a control member for controlling each yarn feeder separately from its yarn feeder control drum, movement means adapted to be moved by the associated pattern drum, and coupling means adapted to be operated by the movement means and being adapted to transmit such movement to the control member for causing a particular control to be effected on its associated yarn feeder.

The control member may include a pivotably mounted lever, at one end being adapted to move a yarn feeder selectively into and out of operation for supplying yarn to the knitting cylinder and at its other end being connected to the coupling means for movement thereby.

The coupling means may include a Bowden cable, which at one end is operatively joined to the control member and at the other end is operatively joined to the movement means.

The movement means may include a first lever for each yarn feeder to be controlled, the lever being adapted to be moved by pins provided on the pattern drum, the first lever being adapted to pivot a slidable lever into an operative position, the slidable lever being adapted to be moved by means of the rotation of the knitting cylinder for causing movement of the control member via the coupling means.

The machine may include a cam adapted to be driven off the knitting cylinder, the cam having a sector of less than 60° for which the slidable lever is moved to cause operation of the control member.

The first lever may be connected to a needle selector bar, which has been adapted not to operate a needle in the knitting cylinder, and which is movable by means of pins provided on the pattern drum. The first lever may be connected to the needle selector bar by means of a Bowden cable. A yarn guide plate may be provided for each yarn cutter for guiding yarn to its yarn cutter.

The invention will now be described by way of example with reference to the accompanying schematic drawings.

BRIEF DESCRIPTION OF THE DRAWINGS

In the drawings there is shown in

FIG. 4 a schematic and simplified sectional side view of the feeder control part between a needle selector and a lever forming part of the movement means;

FIG. 7 on a larger scale, a pictorial view of part of the feeder control member of the additional yarn feeder control arrangement;

FIG. 8 a plan view of the racking cam driven by the knitting cylinder;

FIG. 9 a side view of the racking cam seen along arrow IX in FIG. 8;

FIG. 10 on a larger scale, a side view of the yarn guide part approximately as seen along arrow X in FIG. 3.

DESCRIPTION OF KNOWN KNITTING MACHINE

Figure 1:
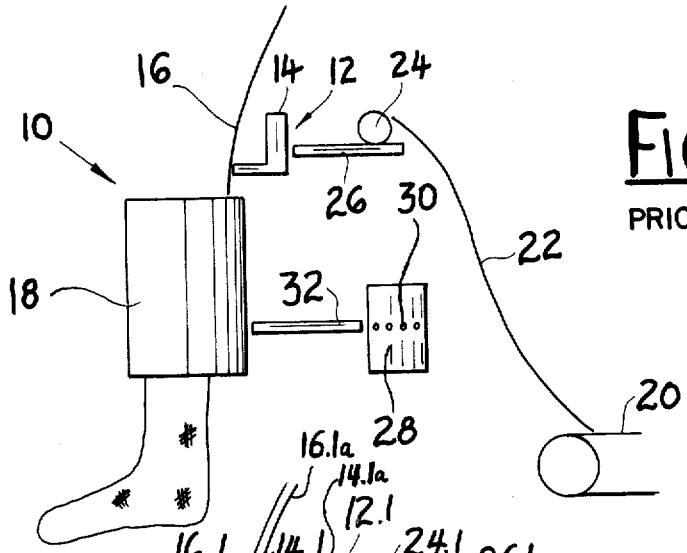
FIG. 1 PRIOR ART
FIG. 1 a block diagram layout of relevant parts of a known knitting machine.

Referring to FIG. 1, a block diagram of certain parts of a known knitting arrangement or machine, in particular one available commercially under the name COLOSIO MODEL C41 ARGYLE KNITTING MACHINE, is shown. This will be referred to as the "existing machine".

The existing machine has as purpose to produce multicolour argyle type socks by way of four feed groups, which are arranged symmetrically about a knitting cylinder. When referring to FIG. 1 it must be noted that, although only one feed group is shown, in fact four feed groups are provided and that they all are substantially similar.

The existing machine, generally indicated by reference numeral 10, has four knitting feed groups of which one feed group 12 is shown. Each feed group has three yarn feeders 14, i.e. the machine has twelve yarn feeders in total. Each yarn feeder receives a yarn 16. These yarn feeders 14 are arranged around a knitting cylinder 18. In the existing machine one of those yarn feeders 14 in the third feed group is used for the build-up of the ribbed top of the sock, and thereby the colours used in this feed group are limited to two (instead of three as in the other groups).

The build-up of the sock is controlled by means of a timing chain 20, which is used to control the various yarn feeders 14 via a cable 22 controlling a feeder control drum 24 at each of the four feed groups 12. The feeder control drum 24 selectively drives or racks the feeders 14 via a lever 26. Each such change is a so-called "feed change". In the existing machine the number of feed changes in each feeder control drum 24 is limited to a maximum of ten per feed group. Some of those ten feeder changes are used for the build-up of the sock and therefore the feeder changes available for the actual pattern area is further limited.

In order to produce different patterns a pattern drum 28 with holes to take pattern pins 30 is mounted under each feed group, and by placing the appropriate pins in the holes of each pattern drum 28, the needle selectors 32 are operable on multibutt jacks so that a pattern is formed in the knitting cylinder 18 by appropriate movement of associated needles.

The cylinder 18 is driven by a motor and gearbox (not shown). The pattern is formed by way of a reciprocating movement of the knitting cylinder 18 through 360°. The pattern drums 28 move one rack after each reciprocation of the cylinder 18, and by means of the pattern pins 30 and various knitting elements in the knitting cylinder 18, one or more needles are selected to knit in each feed course part. The different parts of the fabric knitted in each feed course are joined together by selecting the same needle to knit in each adjoining feed part during that feed course. As there are only four feeder course parts available to complete a full circle, there can be only four colours joined in each course of the fabric.

DESCRIPTION OF PREFERRED EMBODIMENT

A basic object of the invention is to control the feeders 14 of the feeder groups 12 by means other than the control chain 20, so that the feeders 14 are controllable in unlimited fashion and are not restricted to ten feeder change movements on the feeder control drum 24.

Figure 2:
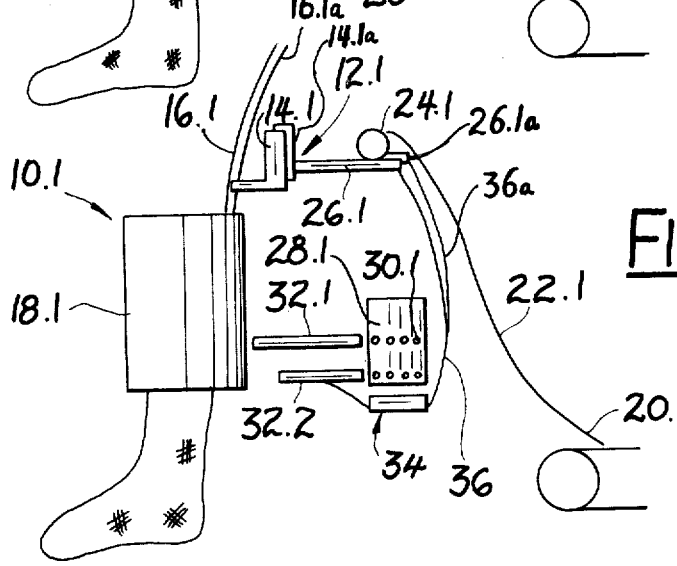
FIG. 2 a block diagram layout similar to FIG. 1 but showing relevant parts of the feeder control arrangement in accordance with the invention and as provided on a known knitting machine.

In FIG. 2 a block diagram of the layout of essential parts in a knitting machine provided with an additional feeder control arrangement in accordance with the invention is illustrated. The same reference numerals are used for the same parts as in FIG. 1, but with the addition of the numeral .1 for differentiation purposes.

It must be noted that although in the description regarding FIGS. 3 to 10 reference mostly is made to one feeder, a control mechanism and links exist for each feeder separately.

According to the invention, the knitting machine 10.1 of FIG. 2, which includes the same parts as in the existing machine 10 (i.e. a knitting cylinder 18.1, yarn feeder groups 12.1, which includes depicted yarn feeders 14.1 and 14.1*a* and corresponding levers 26.1 and 26.1*a*, a timing chain 20.1, pattern drums 28.1 and the various controls) further includes an additional feed control arrangement 34 controllable by means of the pattern drum 28.1. The control arrangement 34 broadly includes a coupling means in the form of a cable connection 36 and 36*a* to each feeder 14.1 and 14.1*a* (only two being depicted) of each yarn feeder group 12.1, i.e. if there are three feeders then three cables would be provided.

The control arrangement 34 further includes movement means comprising various elements, such as being connected via a cable to a needle selector 32.2, which is operable by means of the pattern drum 28.1 but which is not operatively connected to the knitting cylinder 18.1. Full details of the other parts of the movement means will be set out in the description following hereafter.

Figure 3:
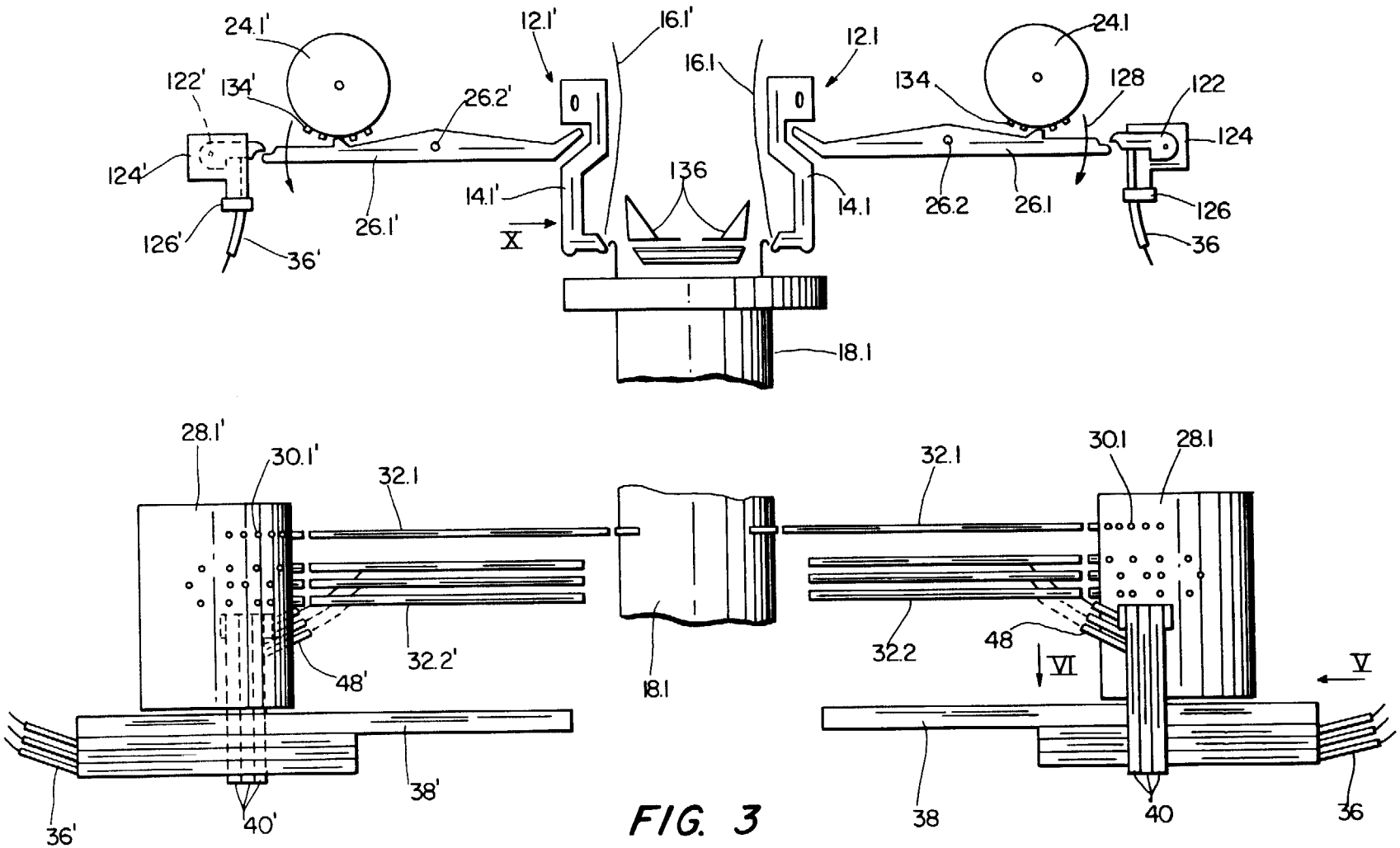
FIG. 3 on a larger scale, a schematic side view of the relevant parts of the additional yarn feeder control arrangement in accordance with the invention and showing relevant parts of the known knitting machine.
Figures 5, 6:
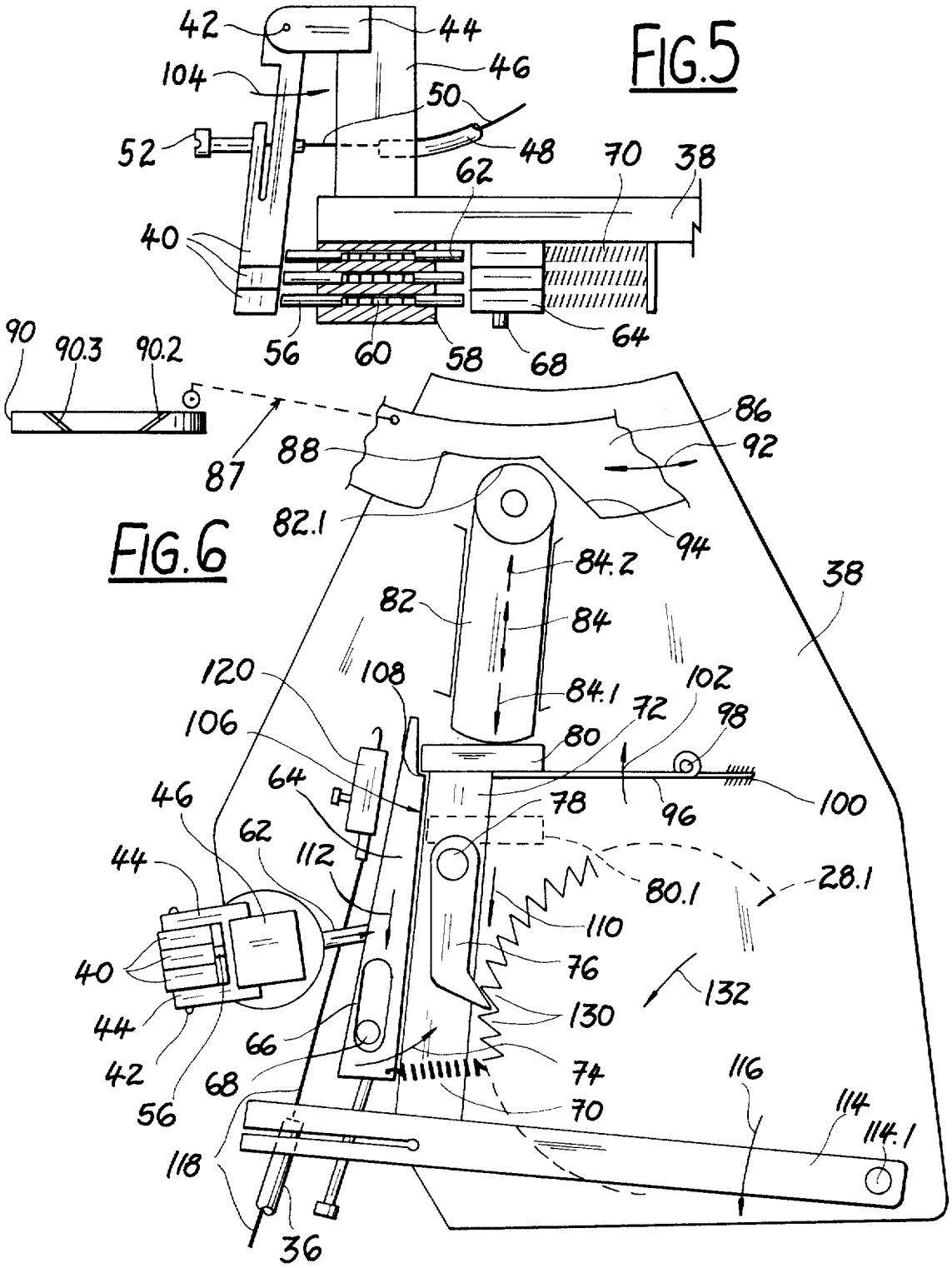
FIG. 5 on a larger scale, a sectional side view of part of the feeder control arrangement at the levers controlled off the pattern drum, and as seen along arrow V in FIG. 3.
FIG. 6 a view from above of the control movement means of the additional yarn feeder control arrangement and substantially as seen along arrow VI in FIG. 3 (but on a larger scale)

The movement means of the feeder control arrangement are basically shown in FIGS. 3, 4 and 5. In FIG. 3, two yarn feeder groups and two pattern drums and associated elements are shown wherein the same reference numerals are used for the same part as in FIG. 2, but with the addition of a prime for the additional elements. As is shown, on the pattern drum base plate 38 three (first) levers 40 are pivotably mounted by means of a pin 42 (FIG. 5) on side lugs 44 connected to a support block 46. For each lever a Bowden cable 48 is connected in normal manner at one end to the block 46 and the free end of the cable wire is connected to its lever 40. An adjustment screw 52 is connected to the free end of the cable wire 50 to adjust the tension in the cable. The other end of the cable wire 50 (FIG. 4) is connected by means of a clamp 54 to the needle selector 32.2. The ends of the levers 40, opposite to the pivot point at 42, each cooperate with its pin 56 respectively slidably mounted in block 58 and the pins 56 press onto the springs 60 (see FIG. 5). The pins 62, slidably mounted at the opposite ends of the springs 60, cooperate with the floating or slidable levers 64. As shown in FIG. 6 the levers 64 have an oblong hole 66 in which a pivot pin 68 engages. The pivot pin 68 is fixed to the base plate 38. Each lever 64 is biased by means of its coil spring 70 away from the bar 72 in the direction indicated by arrow 74.

The bar 72 is a floating bar which slides in a slot in the base plate 38. The rack lever 76 is pivotably mounted on the bar 72 by means of the pin 78. The bar 72 has a bent off part 80 which abuts against a floating bar 82, which is reciprocatingly movable in the direction of arrow 84. A ring 86 having four cut-outs 88 (one for each control device) engages at the free end 82.1 of the bar 82. The cam 90 (FIG. 8) which is driven by the gearbox driving the knitting cylinder 18.1, operates the ring 86 by moving it reciprocatingly in the direction of arrow 92 by means that would be obvious to one skilled in the art, such as by a mechanical linkage shown schematically in FIG. 6 with dashed line 87. The sloping face 94 of the cut out 88 moves the bar 82 in the direction shown by arrow 84. If the face 94 presses against the end 82.1 of the bar 82, it is moved away in the direction of arrow 84.1. If the face 94 moves away from the bar 82, then the spring 96, which is mounted on the pin 98, is fixed at 100 to the base plate 38 and is biased in the direction of arrow 102, acts on the part 80 and moves the bar 82 back into the cut-out 88 in the direction of arrow 84.2.

If a particular pin 30.1 on the pattern drum 28.1 acts on one of the selectors 32.2 coupled to the control arrangement it moves its cable wire 50 in the direction of arrow 50.1 (FIG. 4) and pivots its respective lever 40 in the direction of arrow 104, and the lever 40 pushes on its pin 56, and compresses its respective spring 60, which in turn pushes on its pin 62 and attempts to bring its lever 64 into the working position. However, at this stage the bar 72 and its arm 80 are in the forward position (indicated by dotted lines 80.1 in FIG. 6) held by the cam 86, via the sloping face 94 acting on the end 82.1 of the bar 82, etc. The lever 64 therefore cannot move forwardly as its side 106 rests against the part 80, which has been moved to the position shown in dotted lines 80.1.

When the knitting cylinder 18.1 reaches the dead centre of reciprocation, the cam 90 will move the ring 86 so that the bar 82 slides back into the cut-out 88, and the bar 72 and the arm 80 will move into the position shown in FIG. 6. The shoulder 108 of the lever 64 then engages against the arm 80 because of the pressure exerted by the pin 62 against the action of the spring 70. Now, when the cam 90 causes movement of the bar 82 in the direction of arrow 84.1, then the bar 72 and its arm 80 are moved in the direction of arrow 110. As the part 80 engages behind the shoulder 108 of the lever 64, the lever 64 is taken along by the part 80 in the direction of arrow 112 and pivots the lever 114, pivotably mounted at 114.1 to the base plate 38, in the direction of arrow 116. Thereby its Bowden cable 36 is operated. The cable wire 118 of the Bowden cable 36 is anchored at one end to the block 120, which is mounted on the base plate 38, and at the other end is connected to the control member in the form of a lever 122 (FIG. 3), which is mounted on the support block 124, with its cable housing abutting against the plate 126, and presses the lever 26.1, which is pivoted at 26.2 down at the back in the direction of arrow 128. Thereby the feeder 14.1 of the feeder group 12.1 is lifted and held out of the working position.

When the bar 72 moves in the direction of arrow 110, the rack lever 76, which engages on the rack teeth gear 130 of the pattern drum 28.1, rotates the pattern drum 28.1 for an equivalent distance in the direction of arrow 132 (See FIG. 6).

Referring to FIG. 3, the feeder 14.1 otherwise normally would have been held out of the working position by means of the feeder drum 24.1 acting on the lever 26.1 via its pins 134.

The cam 90, which is referred to above and which is shown in FIGS. 8 and 9, has a raised part 90.1, slopes 90.2, 90.3 and an open part 9.4. The cam 90 is coupled directly to the knitting cylinder 18.1 and controls the ring 86 (FIG. 6). The cut-out 88 of the ring 86 corresponds to the open part 90.4 of the cam 90.

On further rotation of the pattern drum 28.1 as soon as no further pins 30.1 act on the needle selector 32.2, it is released, the lever 40 is returned to its position of rest, the lever 64 moves away from the bar 72, and the bar 72 and the bar 82 are moved into their withdrawn position as shown in FIG. 6. Simultaneously the feeder 14.1 is brought into operation. The duration of operation or keeping out of working of the feeder 14.1 therefore is determined by the number of pins 30.1 provided on the pattern drum 28.1 for operating the needle selector 32.2.

Referring to FIG. 10 (also shown schematically in FIG. 3) special yarn guides 136 are provided for the yarn supplied by the feeders 14.1 when operated by the cable 36. The guide 136 is used to prevent yarn to be trapped in the holding brushes during the patterning process but still allowing the yarn to be cut selectively. It has a flat raised part 138 on one side (preventing yarn from being trapped in the holding brushes during the patterning process), and a base 140, and a knob 142 over which the yarn can slide prior to being cut by the cutter 144 on the side opposite to raised part 138.

The device in accordance with the invention therefore makes it possible to do the following:

1. To produce any standard pattern as could be done by means of the existing machine by way of the known control off the timing chain. However, since the feeders 14.1 are also controlled by pins 30.1 in the pattern drum 28.1 one can introduce as many colour strips in each or one individual block of the patterns as may be desired.

2. To produce a standard argyle diamond pattern but with a truly knitted overcheck, and not as is done commonly by overplating.

3. To produce patterns which have more than four joints in each course of the fabric. By means of this arrangement two of the three feeders in each feeder group 12.1 are used in each feed at a time, and the feeder required is selected by means of a pattern pin 30.1 in the pattern drum 28.1 and is not controlled from the control chain 20.1. (This arrangement applies only to the pattern area and the control chain 20.1 is used in the normal manner for all other knitting parts of a sock to be knitted.)

Thereby, in accordance with the additional yarn feed control arrangement provided by means of the invention, it is possible to knit two courses on one part of a sock in one colour, then two courses in another colour, and to come back to the first part to carry on the first colour block or diamond area or whatever shape or pattern is to be knitted.

However, due to this type of knitting it is not possible to join the different colour parts in each course, but the joining takes place in the vales only. This results in a slightly open joint. Due to the type of knitting process as set out above, the duration of the patterning process is doubled if the arrangement in accordance with the invention is used for patterns as laid down in paragraphs 2 and 3 above.

Therefore depending on the double knitting applied, the total time per sock increases by about one third of the normal time.

This timing does not apply if the normal knitting procedure is followed as set out in paragraph 1.

Figure 11:
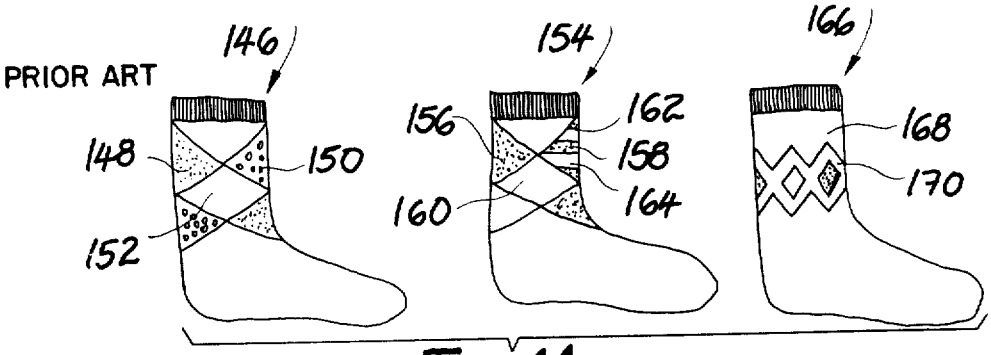
FIG. 11 a schematic side view of socks with some types of patterns which can be knitted by means of a known knitting machine and a knitting machine provided with an additional yarn feeder control arrangement in accordance with the invention.

In FIG. 11 the sock 146 shows the ordinary sock with two colour diamond parts 148, 150 and an intermediate third colour part 152. This is done when using the existing machine in its normal manner, i.e. controlling the feeders off the timing chain.

The next sock 154 has two diamond parts 156, 158 and an intermediate part 160. However in the part 158, stripes 162, 164, etc. are provided. This is done by means of the control arrangement in accordance with the invention.

The third sock 166 has a single coloured part 168 with a multi-coloured patterned part 170 as shown. Therefore eight joints are provided. This sock 166 also is produceable due to the provision of a control arrangement as set out herein.

I claim:

1. A knitting machine for knitting tubular knitted wear such as socks, which includes a rotatable needle knitting cylinder; a number of pattern drums each drum capable of mounting pattern pins; a number of needle selector bars adapted to be operated by the pattern drums and in turn being adapted to operate needles in the knitting cylinder; a number of yarn feeder control drums controlled from a timing chain; yarn feeders for each yarn feeder control drum which yarn feeders are adapted to supply yarn to the needle knitting cylinder; the machine further including an additional yarn feeder control arrangement which includes a control member for controlling each yarn feeder separately from the said corresponding yarn feeder control drum; movement means adapted to be moved by the associated pattern drum of the yarn feeders; and coupling means adapted to be operated by the movement means and being adapted to transmit movement of the movement means to the control member for causing a particular control to be effected on its associated yarn feeder; the movement means including a first lever for each yarn feeder to be controlled, the lever being adapted to be moved by pins provided on the pattern drum, the first lever being adapted to pivot a slidable lever into an operative position; the slidable lever being adapted to be moved by means of the rotation of the needle knitting cylinder for causing movement of the control member via the coupling means.

2. A machine as claimed in claim 1, in which the control member includes a pivotably mounted lever, at one end being adapted to move a yarn feeder selectively into and out of operation for supplying yarn to the knitting cylinder and at its other end being connected to the coupling means for movement thereby.

3. A machine as claimed in claim 1 in which the coupling means includes a Bowden cable, which at one end is operatively joined to the control member and at the other end is operatively joined to the movement means.

4. A machine as claimed in claim 1, in which the first lever is connected to a needle selector bar, which has been adapted not to operate a needle in the knitting cylinder, and which is movable by means of pins provided on the pattern drum.

5. A machine as claimed in claim 4, in which the first lever is connected to the needle selector bar by means of a Bowden cable.

* * * * *